US009560898B2

(12) United States Patent
Hortnagl

(10) Patent No.: US 9,560,898 B2
(45) Date of Patent: Feb. 7, 2017

(54) BUCKLE PARTS OF A BELT BUCKLE

(71) Applicant: ABA Hortnagl GmbH, Fulpmes (AT)

(72) Inventor: Andreas Hortnagl, Fulpmes (AT)

(73) Assignee: ABA HORTNAGL GMBH, Fulpmes (AT)

( * ) Notice: Subject to any disclaimer, the term of this patent is extended or adjusted under 35 U.S.C. 154(b) by 3 days.

(21) Appl. No.: 14/247,600

(22) Filed: Apr. 8, 2014

(65) Prior Publication Data

US 2014/0298630 A1 Oct. 9, 2014

(30) Foreign Application Priority Data

Apr. 9, 2013 (AT) ..... A 265/2013

(51) Int. Cl.
*A44B 11/25* (2006.01)
*A44B 11/00* (2006.01)

(52) U.S. Cl.
CPC ..... *A44B 11/2592* (2013.01); *A44B 11/006* (2013.01); *A44B 11/2519* (2013.01); *A44B 11/2549* (2013.01); *A44B 11/2553* (2013.01); *Y10T 24/45963* (2015.01)

(58) Field of Classification Search
CPC .. A44B 11/2549; A44B 11/2592; A44B 11/25
USPC ..... 24/697.2, 633, 629, 265 BC, 265 EC, 24/178, 188, 170, 163 R
See application file for complete search history.

(56) References Cited

U.S. PATENT DOCUMENTS

| | | | | |
|---|---|---|---|---|
| 1,599,920 | A | 9/1926 | Pryor | |
| 1,877,704 | A * | 9/1932 | Switlik | B64D 25/06 182/3 |
| 1,942,361 | A * | 1/1934 | Littlejohn | A41F 3/02 24/163 R |
| 1,958,643 | A * | 5/1934 | Silverman | A41F 17/00 24/163 R |
| 2,062,734 | A * | 12/1936 | Troendly | A44B 11/04 24/163 R |
| 2,079,981 | A * | 5/1937 | Bednall | A44B 11/24 24/170 |
| D124,604 | S | 1/1941 | Goodwin | |
| 2,847,748 | A * | 8/1958 | Robinton | 24/648 |
| 3,131,674 | A * | 5/1964 | Dalton | 119/865 |
| 3,605,209 | A * | 9/1971 | Alarcon | 24/637 |
| 3,665,565 | A * | 5/1972 | Kruger | 24/265 WS |
| 4,406,043 | A * | 9/1983 | Friedman | A44B 11/006 24/171 |
| 4,493,135 | A | 1/1985 | Crook, Jr. | |
| 5,123,147 | A * | 6/1992 | Blair | 24/636 |

(Continued)

FOREIGN PATENT DOCUMENTS

| | | |
|---|---|---|
| CA | 2209200 | 2/1999 |
| DE | 3925548 | 3/1990 |

(Continued)

*Primary Examiner* — Robert J Sandy
*Assistant Examiner* — Jason W San
(74) *Attorney, Agent, or Firm* — Volpe and Koenig, P.C.

(57) ABSTRACT

A buckle part (2) of a belt buckle (1), wherein the buckle part (2) comprises at least one connecting part (4) for releasably connecting the buckle part (2) to another buckle part (3) of the belt buckle (1) and at least one bar (5) for fastening a belt (26) on the bar (5) of the buckle part (2), wherein the buckle part (2) also comprises at least one clevis type eyelet (6) for hooking a karabiner into the clevis type eyelet (6).

16 Claims, 3 Drawing Sheets

(56) References Cited

U.S. PATENT DOCUMENTS

| | | | | |
|---|---|---|---|---|
| 5,322,037 | A | 6/1994 | Tozawa | |
| 5,351,372 | A | 10/1994 | Ihara | |
| D357,435 | S | 4/1995 | Cook | |
| D364,126 | S | 11/1995 | Ochiai et al. | |
| 5,870,803 | A * | 2/1999 | Jorst | 24/265 WS |
| 6,357,092 | B1 * | 3/2002 | Burrows | 24/644 |
| 6,389,653 | B1 | 5/2002 | Matoba | |
| 6,665,913 | B2 * | 12/2003 | Kosh et al. | 24/193 |
| 7,373,701 | B2 * | 5/2008 | Coulombe et al. | 24/648 |
| 7,480,967 | B2 * | 1/2009 | Kojoori et al. | 24/163 R |
| 7,743,473 | B2 * | 6/2010 | Lin et al. | 24/71 ST |
| 8,181,319 | B2 * | 5/2012 | Johnson et al. | 24/648 |
| D667,753 | S | 9/2012 | Nanbu et al. | |
| D673,880 | S | 1/2013 | Boothby et al. | |
| D683,262 | S | 5/2013 | Fitzpatrick et al. | |
| 8,627,554 | B1 * | 1/2014 | Hagan et al. | 24/630 |
| 8,720,018 | B2 * | 5/2014 | Yoshie et al. | 24/625 |
| 2002/0184742 | A1 * | 12/2002 | Casebolt et al. | 24/634 |
| 2003/0172499 | A1 * | 9/2003 | Uehara et al. | 24/170 |
| 2006/0277727 | A1 * | 12/2006 | Keene et al. | 24/638 |
| 2007/0226961 | A1 * | 10/2007 | Anderson et al. | 24/170 |
| 2010/0071173 | A1 * | 3/2010 | Hortnagl | 24/651 |
| 2010/0146749 | A1 * | 6/2010 | Jung | 24/69 SB |
| 2012/0019042 | A1 * | 1/2012 | Park | 297/477 |
| 2012/0067299 | A1 | 3/2012 | Vollmecke et al. | |
| 2012/0104815 | A1 * | 5/2012 | Miller et al. | 297/250.1 |
| 2012/0312052 | A1 * | 12/2012 | Yliluoma et al. | 63/10 |
| 2014/0007388 | A1 * | 1/2014 | Hartnell | 24/633 |
| 2014/0096348 | A1 * | 4/2014 | Anderson et al. | 24/633 |
| 2014/0215766 | A1 * | 8/2014 | Liu | 24/188 |
| 2014/0215773 | A1 * | 8/2014 | Hortnagl | 24/633 |
| 2014/0251725 | A1 * | 9/2014 | Schurian et al. | 182/3 |
| 2016/0200563 | A1 * | 7/2016 | Chen | B68C 1/14 24/178 |

FOREIGN PATENT DOCUMENTS

| | | |
|---|---|---|
| DE | 4238266 | 5/1993 |
| DE | 9412362 | 10/1994 |
| DE | 4416430 | 11/1995 |
| EP | 2165619 | 3/2010 |
| JP | 2006116140 | 5/2006 |
| WO | 9603864 | 2/1996 |
| WO | 2010130501 | 11/2010 |

* cited by examiner

BUCKLE PARTS OF A BELT BUCKLE

INCORPORATION BY REFERENCE

The following documents are incorporated herein by reference as if fully set forth: Austrian Patent Application A265/2013, filed Apr. 9, 2013.

BACKGROUND

The present invention relates to a buckle part of a belt buckle, wherein the buckle part comprises at least one connecting part for releasably connecting the buckle part to another buckle part of the belt buckle and at least one bar for fastening a belt on the bar of the buckle part. In addition, the invention also relates to a belt buckle for releasably connecting together at least one belt and another belt or another object.

Generic buckle parts serve for the purpose of releasably connecting belts together in cooperation with at least one other buckle part or releasably fastening one belt to another object. Belt buckles are formed of at least two buckle parts and are used, for example, in areas of mountain sports or flight sports but also in the area of personal protective equipment in terms of safety at work and the like and are now widely used. A generic buckle part and also a generic buckle are shown, for example, in EP 2 165 619 A2. Belts are frequently connected together by said belt buckles in the application areas stated. They are often a component part of a climbing belt or similar fall arrest systems.

In order to be able to attach persons or objects to a corresponding safety device or to a rope by a belt or to be able to fasten karabiner hooks or other material on the belt, the mentioned belts are frequently provided with correspondingly sewn-on or sewn-in rings, in particular so-called D rings, or textile loops into which a karabiner hook or the like can be hooked. In a quite general manner, a D ring is a closed semicircle adapted in the widest sense from the letter D. As a rule, it is sewn to the belt or is sewn into said belt with the straight side. The rings or loops form on the belt a kind of clevis type eyelet for karabiners or comparable connectors. The sewing on or sewing in of the rings or loops on or in the belt represents an additional operating step in the production of the belt and consequently additional expenditure, above all it can also result in a weakness in the load-bearing capacity of the belt.

SUMMARY

It is the object of the invention to create a possibility for attaching a karabiner where these disadvantages are avoided.

To achieve said object, the invention provides that the buckle part also comprises at least one clevis type eyelet for hooking a karabiner into the clevis type eyelet.

It is consequently a basic concept of the invention that the buckle part itself includes, in addition to the connecting part for connecting the buckle part to another buckle part and to the possibility for fastening a belt in the form of a bar, also comprises a possibility for attaching a karabiner or the like in the form of the clevis type eyelet. In this case, the clevis type eyelet can also be realized incorporated with the bar or the connecting part as long as the three named functionalities are maintained. For example, the bar can be realized as part of the clevis type eyelet as long as it nevertheless also serves for fastening a belt on the buckle part. In terms of the invention, the belt can be a belt material which is known per se, that is a flat, flexible and longitudinally extended object with a width that is smaller relative to the length. Buckle parts according to the invention can also even be used in corresponding configurations for the purpose of fastening ropes. In this respect, a rope can also be read as a corresponding belt. In this case, the belt, as is known per se, is wrapped around the bar located on the buckle part in order to produce a connection between the belt and the buckle part in this manner. The bar can be a fixed or a displaceable bar, a so-called clamping bar. The term displaceable means that the clamping bar is realized so as to be displaceable with reference to the rest of the buckle part. While fixed bars are not provided as a rule for adjusting the belt, the displaceable clamping bars are very suitable for adapting the belt length. The buckle part can also naturally comprise more than one bar or clamping bar for fastening the belt or also several belts.

Karabiner hooks are known in many different configurations. Commercially available karabiner hooks but also other suitable connecting elements which are usually applied in the application areas described can be suspended in the clevis type eyelets provided according to the invention on the buckle part. Connecting ropes, slings or similar directly to the clevis type eyelet is also conceivable and possible. The clevis type eyelet is, for example, a component which can also be designated as a strap, shackle, ring or eye and is preferably realized in a rigid manner per se. The clevis type eyelet, however, can also be realized as a, preferably flexible, loop, sling or the like on the buckle part. The clevis type eyelet can comprise different forms, for example can be realized as a D-shaped ring or shackle. As a rule, the clevis type eyelet comprises at least one opening which is bordered by the clevis type eyelet, preferably in a circumferentially closed manner.

The connecting part of the buckle part serves for releasably connecting the buckle part to another buckle part. The term releasably means in this context releasably in a non-destructive manner. It therefore concerns a type of connection which is provided for the purpose of being connected and released again multiple times without at the same time resulting in destruction. Releasable connections that are not destruction-free are, for example, such where breaking apart, sawing and cutting up or the like is necessary for separation. The connecting part of the buckle part with the clevis type eyelet can be realized, for example, as a male plug-in projection which for connection to another buckle part is then inserted into the female plug-in projection receiver thereof. The connecting part of the buckle part with the clevis type eyelet, however, can also be realized, for example, as a female plug-in projection receiver into which for connection to another buckle part the male plug-in projection thereof is inserted. Buckle parts according to the invention can consequently be realized as both female and male. However, connecting parts developed in another manner can also be provided for releasably connecting the buckle part to another buckle part.

In a preferred manner, it is provided that the clevis type eyelet is fastened on the remaining buckle part so as to be pivotable about a pivot axis. It is consequently possible to develop the force flow in as favorable a manner as possible. The clevis type eyelet can consequently be adapted in a favorable manner extensively to the pull-direction of the karabiner or of the attached connecting means without running excessive transverse loads between the clevis type eyelet and the remaining buckle part. In a preferred configuration, it is provided that the pivot axis is arranged coaxially with respect to the bar.

Particularly advantageous configurations of the invention provide that the bar is part of the clevis type eyelet. As a result, it can be ensured that the forces introduced by the karabiners, for example, occurring in the event of a drop, are able to be introduced directly into the belt connected to the bar along the shortest possible paths without resulting in large mechanical loads on the remaining buckle part.

In the case of preferred configurations of the invention, it can be provided that the bar and at least one leg of the clevis type eyelet form the clevis type eyelet. This occurs preferably by the bar being guided through holes in the leg. It must be pointed out in this connection that the leg can be mounted so as to be pivotable in relation to the bar. However, it is also possible and is just as good for the bar to be fixedly connected to the leg and consequently connected in a positive locking manner in all directions. In these terms it is also conceivable and possible for the bar and the at least one leg to be developed integrally or in one piece. It must also be pointed out, however, that it is naturally not compulsory for the bar to be part of the clevis type eyelet.

In particularly preferred configurations of the invention, it can be provided that the bar is guided through a, preferably multiple-part, sleeve and the sleeve is arranged between the regions of the leg comprising the holes and supports the regions of the leg comprising the holes and/or preloads them, preferably in the direction away from one another. In its supporting function, in a favorable manner the sleeve prevents the regions of the leg comprising the holes being bent elastically or plastically toward one another when there is a correspondingly large amount of pull on the clevis type eyelet. In its preloading function, it can be utilized for the purpose of preloading the regions of the leg comprising the holes for latching-in, which will be explained again below. A sleeve is generally a component with a tubular cross section through which, in this case, the bar is guided. The sleeve can be realized in a continuously rigid manner for its supporting function. If, which is also preferable, it serves for preloading, it can thus be provided that the sleeve is realized fully or in regions, preferably in the direction of its longitudinal extension, in an elastic manner. It is favorable in this connection when the sleeve is realized in multiple parts. The multiple-part design makes it possible to realize part of the sleeve in an elastic manner in order to enable flexibility of the sleeve, preferably in the longitudinal extension of the sleeve. Along with a design as a multi-part sleeve, it is also conceivable and possible for the sleeve to consist of an elastic or partially elastic material also in one piece. In a favorable manner, the elastic part of the sleeve is an elastomer, preferably a ring-shaped elastomer. However, it is also conceivable and possible to use a suitable spring such as, for example, a helical spring, plate spring or similar known designs of springs, of metal, as the elastic part of the sleeve. Possible design variants of the sleeve will be discussed in the course of the exemplary embodiment. To complete the picture, it is also pointed out again that the sleeve can be connected integrally to the leg, or the sleeve can be connected to the leg using a suitable jointing method.

It is provided in a preferred manner that the clevis type eyelet comprises at least one pivot position, preferably several pivot positions, in which position or in which positions it latches in the remaining buckle part. In a favorable manner, it is provided in this connection that the clevis type eyelet comprises at least one elevation which latches into at least one indentation in a counter piece of the buckle part in one pivot position. It is naturally also conceivable and possible for the at least one elevation to be situated on the remaining buckle part and the at least one indentation to be associated with the clevis type eyelet. In order to enable latching-in in this sense, at least part of the clevis type eyelet and/or the remaining buckle part is/are realized so as to be elastically deformable. It is therefore possible for the leg and/or the sleeve of the clevis type eyelet to be realized so as to be elastically deformable. The preloading for latching-in can be provided, for example, by means of the previously discussed sleeve.

In preferred configurations it is provided that the clevis type eyelet includes an opening, preferably an opening which it borders in a circumferentially closed manner, for attaching the karabiner or the like. The opening can be realized in various manners. In order to be able to attach the karabiner, it is however favorable when the opening is large enough for a circle which inscribes said opening to comprise a minimum radius of at least 5 mm, preferably of at least 7 mm. This circle, as a rule, is only imaginary in order to inscribe the minimum size of the opening, but is not physically present.

The invention includes along with the buckle part also a belt buckle for releasably connecting together at least one belt and another belt or another object, wherein the belt buckle comprises at least one buckle part according to the invention, on the bar of which the at least one belt is fastenable, wherein the belt buckle comprises at least one other buckle part on which the other belt or the other object is fastenable and to which the buckle part is releasably connectable by means of its connecting part. In this case, the above statements in terms of destruction-free releasability also apply to the term of releasable connectability. It is also conceivable and possible in this case for the other buckle part also to be a buckle part according to the invention, which comprises the corresponding counter piece to the connecting part of the other buckle part, for attaching a karabiner into the clevis type eyelet associated therewith.

Preferred configurations of the invention provide that when connecting together, the buckle parts latch onto one another by means of a latching device and a latching element, preferably a latching lever, of the latching device has to be actuated, preferably by hand, to release the buckle parts from one another. To connect the buckle parts together, in a favorable manner they only have to be moved into contact with one another until they latch into one another or onto one another by means of the latching device. To separate them in contrast, in a favorable manner a targeted actuating of the at least one latching element is necessary. It is therefore preferably provided in this connection that the releasing of the buckle parts is possible exclusively as a result of targeted actuating of the latching device.

Preferred configurations of the invention provide that the latching device engages the latching element in the latched-in state in an undercut at least of one connecting part. The undercut can be realized in or on the plug-in projection of the male buckle part. In this case, the latching device is then in a favorable manner part of the female buckle part. There are naturally also configurations of the invention where this is precisely in reverse. In said configurations, the undercut is then realized in the female buckle part, therefore in particular in the plug-in projection receiver thereof and the latching device or latching devices are then part of the male buckle part. In a preferred manner, it is provided that the latching device is realized as a latching lever which is pivotable about a pivot axis. The latching device or the pivotable latching lever is spring-loaded in a favorable manner in the direction toward the latching-in position. In a preferred manner, it comprises a gripping region on one side of its pivot axis and a latching-in region on the side of the pivot axis that is opposite thereto.

BRIEF DESCRIPTION OF THE SEVERAL VIEWS OF THE DRAWINGS

Further features and details of preferred configurations of the invention are explained as an example by way of the variants according to the invention which are shown in the Figures, in which.

DETAILED DESCRIPTION OF THE PREFERRED EMBODIMENTS

Figure 1:
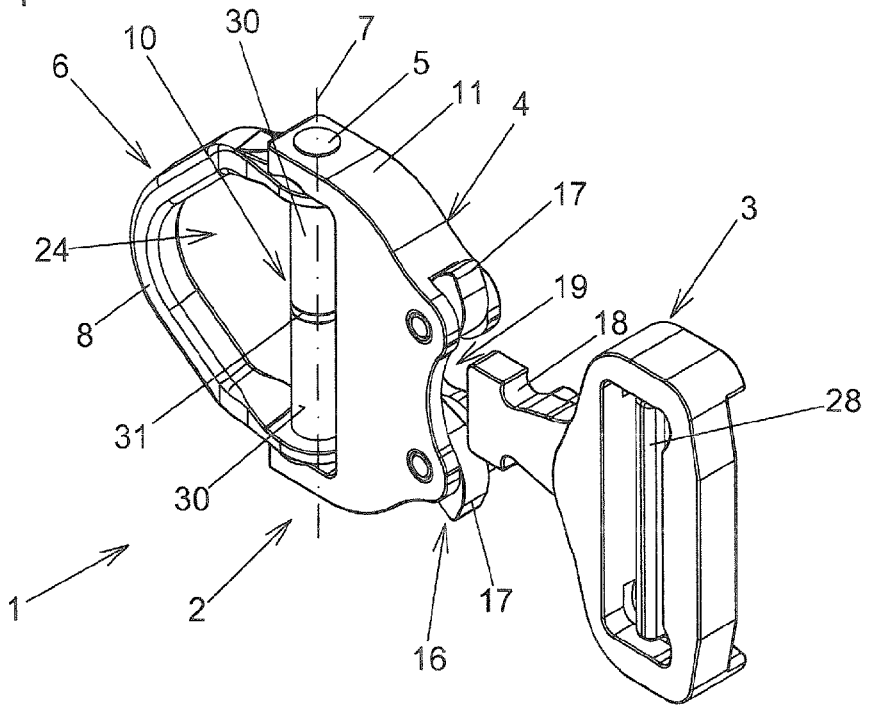
FIG. 1 shows an isometric view of a belt buckle according to the invention, with the buckle parts in the separated state.

FIG. 1 shows an isometric view of a belt buckle 1 according to the invention. It is easy to see the buckle part 2 according to the invention and the other buckle part 3, said buckle parts 2, 3 being shown in FIG. 1 in an arrangement where they are not connected together. The other buckle part 3 comprises a plug-in projection 18, the other buckle part 3 being a male buckle part. The buckle part 2 according to the invention comprises a plug-in projection receiver 19 as the connecting part 4 and consequently forms a female buckle part. This arrangement is not compulsory. It is possible in an equally good manner for the other buckle part 3 to comprise a plug-in projection receiver 19 and the buckle part 2 according to the invention to comprise a plug-in projection 18. Connecting parts which are completely different can also be provided, such as, for example, hooks and hooks or hooks and eyes.

The buckle part 2 is consequently part of a belt buckle 1 with at least one connecting part 4 which is realized as a plug-in projection receiver for releasably connecting the buckle part 2 to the other buckle part 3 of the belt buckle 1, and comprises a bar 5 for fastening a belt on the bar 5 of the buckle part 2, the buckle part 2 additionally comprising a clevis type eyelet 6 for attaching a karabiner hook into the clevis type eyelet 6. In said exemplary embodiment, the bar 5 is part of the clevis type eyelet, but, as already stated, this does not have to be the case.

As can also be seen in FIG. 1, the buckle part 2 comprises a basic body 11 which, in this case, once again comprises the connecting part 4, which is female in said exemplary embodiment, for releasably connecting the buckle part 2 to the other buckle part 3 of the belt buckle 1. The bar 5 shown in FIG. 1 serves for fastening the belt 26 on the buckle part 2. As already mentioned, the belt 26 can also be a strap or a rope or similar. The belt 26, as also the other belt 27 which is fastened on the other buckle part 3, is only shown in FIG. 3 and is only shown there by a broken line. The fastening of the belt 26 on the bar 5 and also the fastening of the other belt 27 on the other bar 28 of the other buckle part 3 can be effected in all manners that are known per se. Both bars 5 and 28 can be realized as fixed bars or as clamping bars which are displaceable relatively to the respective basic body or also to other bars of the respective buckle part 2, 3. The bar 5, in this case, is guided through two opposite holes 29 of the basic body 11 of the buckle part 2 and is plastically deformed in the end regions of the bar 5 lying outside in each case in order to prevent the bar 5 from falling out. The bar 5 can naturally also be fastened in another manner on the basic body 11, or can even also be a fixed part of the basic body 11. It is also conceivable and possible to realize the bar 5 as a screw-type element, such as, for example, a screw, it being possible for one of the two opposite holes 29 of the basic body 11 to be realized as a threaded bore. In this connection, it is naturally also possible for the bar 5 which is realized as a screw-type element to penetrate the two opposite holes 29 of the basic body 11 and to be secured by way of at least one nut. In order to prevent the screw-type connection being unintentionally released, reference is made to common nut and screw retaining elements and/or materials that are known per se. The bar 5, the multiple-part sleeve 10 and the leg 8 form the clevis type eyelet 6 in this exemplary embodiment.

In this exemplary design, it is provided that the clevis type eyelet 6 is fastened on the remaining buckle part 2 or the basic body 11 thereof so as to be pivotable about a pivot axis 7. It is consequently provided that the clevis type eyelet 6 is able to rotate or pivot with reference to the remaining buckle part 2, it being possible to pivot relatively between the bar 5 and the basic body 11, and/or between the bar 5 and the leg 8 and/or the between the leg 8 and the multiple-part sleeve 10 and/or between the bar 5 and the multiple part sleeve 10. In principle, it would also be conceivable and possible for the clevis type eyelet 6 to be connected to the remaining buckle part 2 in particular in a rotationally fixed manner and/or to be realized separately from the bar 5 and/or the sleeve 10. In particular in the case of a design of the clevis type eyelet 6 where it is rotationally fixed in relation to the remaining buckle part 2 or the basic body 11 thereof, it is conceivable and possible for the at least one clevis type eyelet 6 and the remaining buckle part 2 or the basic body 11 thereof to be realized integrally or in one piece.

In the exemplary embodiment shown, the buckle part 2 also additionally comprises the latching device 16 for latching the two buckle parts 2, 3 together. More details of the function of the latching device 16 will be given further below.

It is also easy to see in FIG. 1 that the pivot axis 7, about which the clevis type eyelet is pivotable, is arranged coaxially with respect to the bar 5. This is not compulsory; however, as a result of said arrangement advantages are produced with regard to a compact design of the buckle part according to the invention. It is conceivable and possible in an equally good manner for the leg 8 to be aligned, or arranged independently of the bar 5, at another position with the remaining buckle part, and in particular the pivot axis 7.

Figure 2:
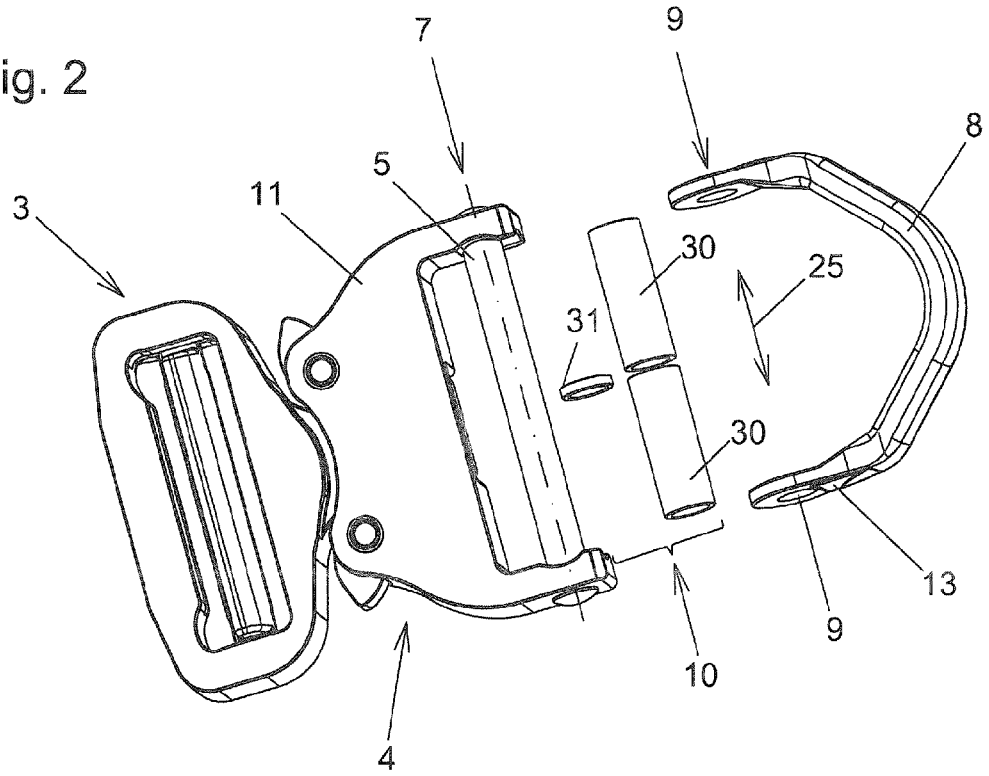
FIG. 2 shows an exploded drawing in the region of the clevis type eyelet.

FIG. 2 shows a partially exploded drawing of a belt buckle 1 according to the invention. The buckle part 2 is now connected to the other buckle part 3 and latched thereto. The design of the exemplary embodiment of a clevis type eyelet 6 which is realized in this case can be seen particularly well in FIG. 2. As already mentioned, for fastening the belt 26 to the basic body 11 the bar 5 is fixedly connected with regard to its position. This is naturally not compulsory as the bar 5, as mentioned above, could be a displaceable clamping bar. It can also be easily seen that the bar 5 forms the clevis type eyelet 6 with the leg 8 of the clevis type eyelet 6 by the bar 5 being guided through holes 9 in the leg 8. The holes 9 are situated on the opposite sides, in this case end regions, of the leg 8. It can easily be seen that the pivot axis 7 shown is arranged coaxially with respect to the bar 5 in said exemplary embodiment. FIG. 2 also shows the design of the sleeve 10 which, in this case, is realized in multiple parts. In the exemplary embodiment shown, the sleeve 10 comprises two portions 30 which are substantially rigid per se and an elastic ring 31 lying in between them. As one unit, the sleeve 10 assumes its function, already mentioned in the introduction, of supporting the two ends of the bent leg 8 in the event of high tensile loads on the clevis type eyelet 6. In said exemplary embodiment, the elastic ring 31 serves for the described preloading and ensures, as explained again below, that the leg 8 and consequently the clevis type eyelet 6 latch-in in the pivot positions in which this is provided. In addition, the elastic ring 31 also serves for preventing gaps which sometimes occur between the portions 30 of the sleeve 10 and/or between the leg 8 and the sleeve 10 during pivoting or in the pivot positions of the clevis type eyelet. These gaps can otherwise result in ingress of dirt or dust or even in the belt 26 jamming or hooking on the bar 5 or the sleeve 10. This can then subsequently result in damage to the belt 26, or can impair the adjustability of the belt 26. To complete the picture, it must be mentioned that this naturally also applies to an integral, elastic design of the sleeve. It is pointed out that the sleeve 10 can comprise all but also only part of the named functions. For example, the preloading function of the sleeve 10 can be omitted if the preloading is applied by the leg 8 itself or by the basic body 11.

Looking at the assembled state of the buckle part 2 in FIG. 1 and the exploded drawing in FIG. 2, it is easily comprehensible that the bar 5 in the exemplary embodiment is guided through the multiple-part sleeve 10 and the sleeve 10 is arranged between the regions of the leg 8 comprising the holes and supports the regions of the leg 8 comprising the holes 9 or preloads them in the direction 25 away from one another. In this case, it is possible for the sleeve 10 to be realized completely or in regions in an elastic manner, where applicable also in an integral manner. The sleeve 10 is a preferably tubular body, through which the bar 5 is guided. FIG. 2 shows the directions 25 in which the sleeve 10 acts on the leg 8 for supporting and/or preloading. The sleeve 10, in this case, along with the job of preloading the leg 8, also has the supporting function where it is a question of ensuring the geometry of the leg 8 even when large tensile loads act on it. It is easy to imagine that a tensile load produced by a karabiner which is hooked in the clevis type eyelet 6 could result in a reduction in the spacing between the regions of the leg comprising the holes 9 depending on the effective direction. The sleeve 10 prevents this by preventing the leg 8 possibly deforming elastically or plastically and consequently permanently in the region of the bar 5. In said exemplary embodiment, the clevis type eyelet 6 comprises an elevation 13 in the region of the leg 8, the function of which elevation is explained further below.

Figure 3:
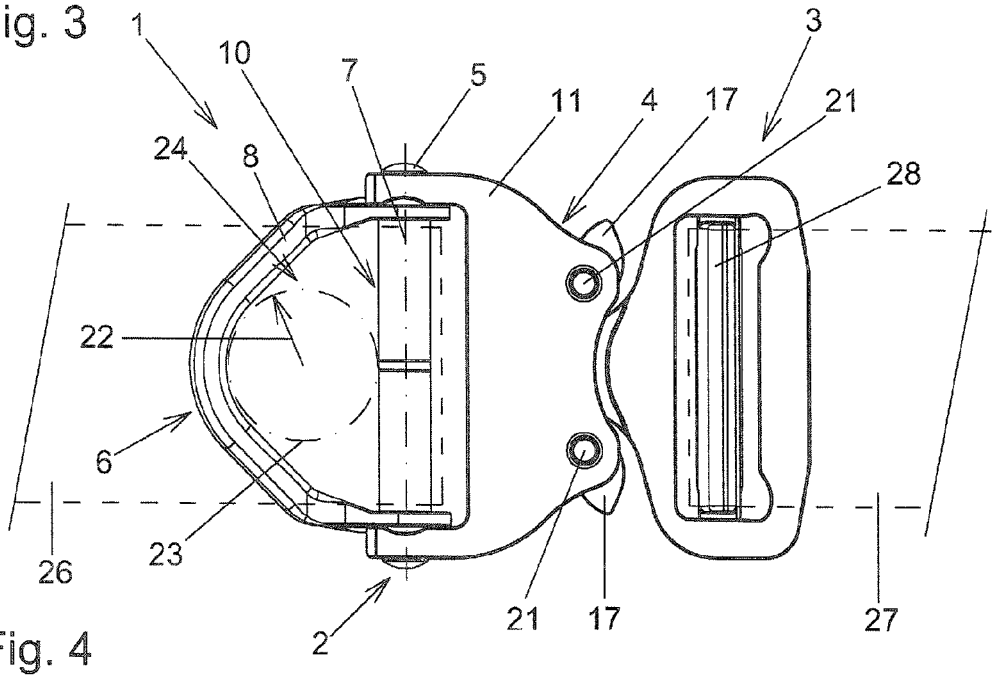
FIGS. 3 and 4 show views of a belt buckle according to the invention in the connected and latched-in state.
Figure 4:
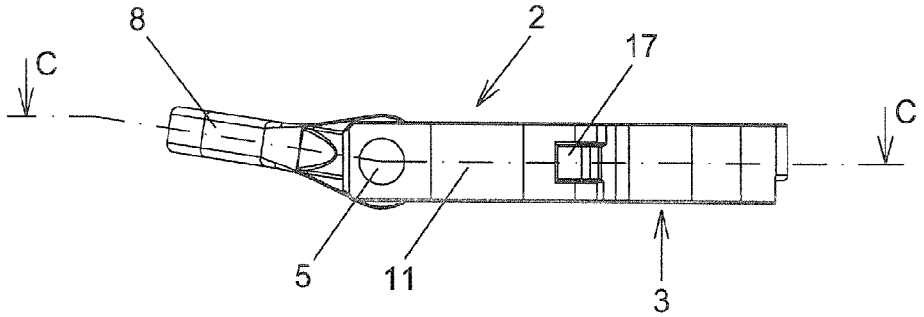

FIG. 3 and FIG. 4 show views of a belt buckle 1 according to the invention with the buckle parts 2 and 3 in the connected and latched state. It can seen particularly well that the clevis type eyelet 6 of the buckle part 2 includes in a circumferentially closed manner an opening 24 for attaching the karabiner hook, an imaginary circle 23 inscribed in said opening 24 in a favorable manner comprising a minimum radius 22 of at least 5 mm, preferably of at least 7 mm. In said exemplary embodiment, the opening 24 is defined by the sleeve 10 and the leg 8.

Figure 5:
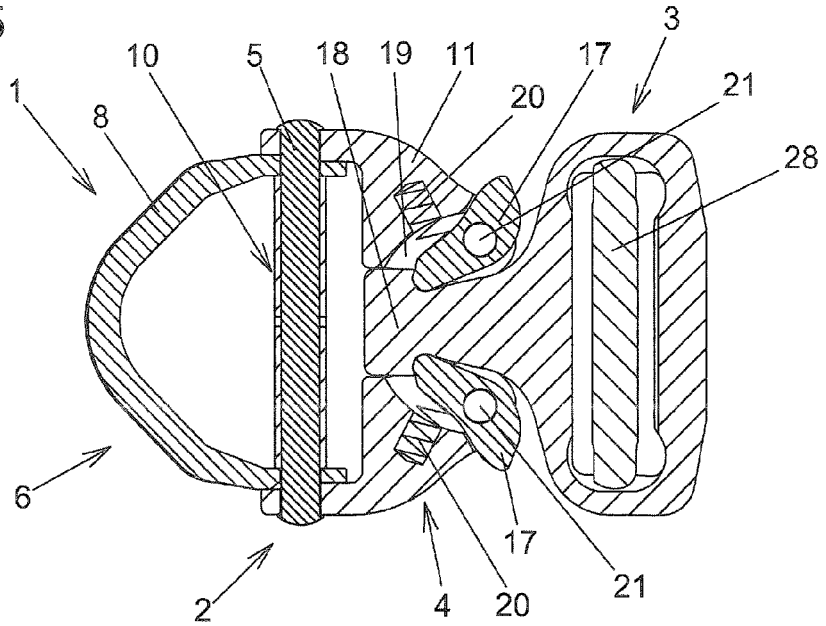
FIG. 5 shows the section C-C according to FIG. 4.
Figure 6:
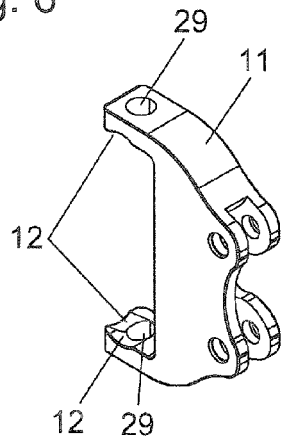
FIGS. 6 to 8 show the basic body of the buckle part with the clevis type eyelet.

FIG. 4 shows a side view of the belt buckle 1 according to the invention and the line of intersection C-C. In order to show in a better manner the functionalities of the buckle part 2 and of the latching device 16 as well as the connection to the other buckle part 3, as is realized in the variant shown here, the section along the line of intersection C-C is shown in FIG. 5. It can also easily be seen here that the bar 5 is connected in a positive locking manner to the basic body 11. It can also easily be seen in the sectioned representation in FIG. 5 that the leg 8 and the bar 5 or the sleeve 10 border the opening 24 in a circumferentially closed manner.

The connecting part 4 of the buckle part 2 is realized, in this case, as a female plug-in projection receiver 19. The buckle part 2 is consequently a female buckle part. In this exemplary embodiment, the buckle part 2 additionally comprises a latching device 16, the buckle parts 2, 3 latching into one another when connecting together by means of said latching device 16 and the latching elements 17, realized in this case as a latching lever, of the latching device 16 having to be actuated, preferably by hand, for releasing the buckle parts 2, 3 from one another. In order to secure the latching-in of the latching element 17, springs 20 are built in the latching device 16. Said springs 20 can be metal helical springs, but also elastomer springs or other suitable spring elements or spring materials. It is easily comprehensible that when inserting the plug-in projection 18 into the plug-in projection receiver 19, the latching elements 17 are pivoted about the pivot axis of the bolts 21 and the springs 20 are compressed as soon as the T-shaped plug-in projection 18 slips along the latching elements 17. When moved further closer together, the undercut of the T-shaped region of the plug-in projection 18 passes the latching elements 17, as a result of which the latching elements 17 latch in the undercut under the influence of the spring-preloading of the springs 20 and consequently secure a positive locking connection between the buckle parts 2 and 3. In said exemplary embodiment, it is provided that the latching elements 17 have to be moved by hand, as a result of a targeted actuation, in order to release the T-shaped plug-in projection 18 or the undercut thereof and to release the positive locking connection between the buckle parts 2, 3 again in order to be able to separate said buckle parts from one another.

In general, it must be stressed that all the components of the belt buckle 1 can be formed of metal, metal alloys or other suitable materials or can comprise said materials at least in part. It is conceivable and possible, in particular, for the named parts also to be able to consist at least in part of plastics material, in particular fiber-reinforced plastics material. The sleeve 10 can be formed of at least in part of an elastomer, for example rubber or a metal spring element. In particular rubber/metal elements but also plastics materials, fiber-reinforced plastics materials and also two-component plastics materials are conceivable and possible.

It is pointed out once again at this point that the latching device 16 can also be part of the other buckle part 3, that is in particular of a male buckle part. In this case, it is not compulsory for the preloading of the latching element 17 to be realized by a spring 20. Rather, it is also conceivable and possible to develop the latching element 17 itself as a resilient element and/or to realize it integrally with the plug-in projection 18 or the plug-in projection receiver 19.

The realizing of the pivot positions of the buckle part 2 according to the invention is now shown by way of FIGS. 6 to 12. In one or a few of the possible pivot positions the clevis type eyelet 6 can latch onto the remaining buckle part 2 or the basic body 11. In the exemplary embodiment, the basic body 11 has several indentations 12 for this purpose.

Figure 7:
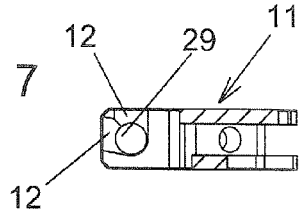
Figure 8:
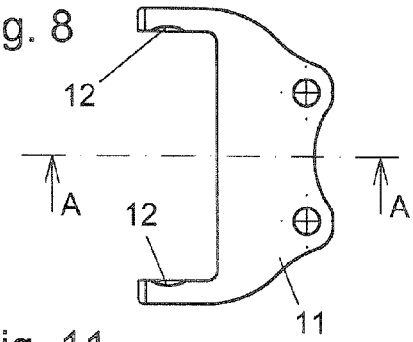
Figure 9:
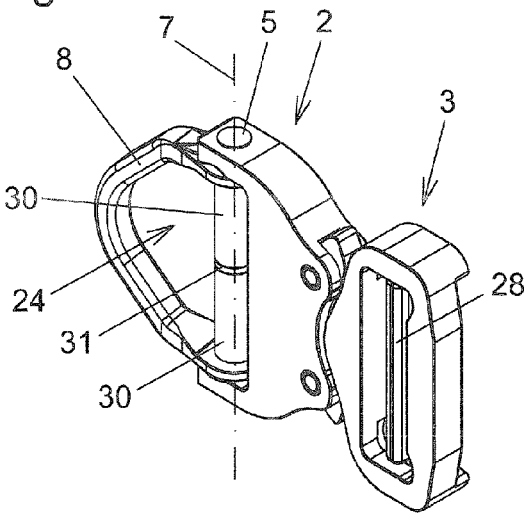
FIGS. 9 to 12 show different pivot positions of the clevis type eyelet.
Figure 11:
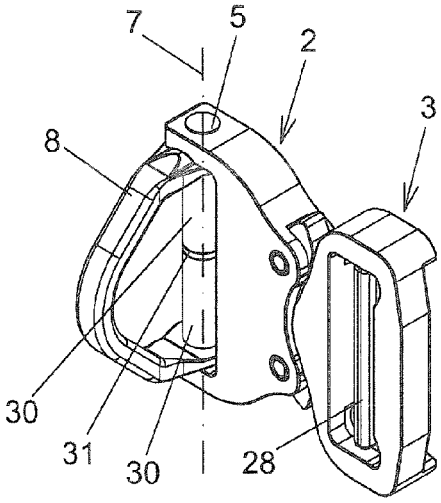
Figure 10:
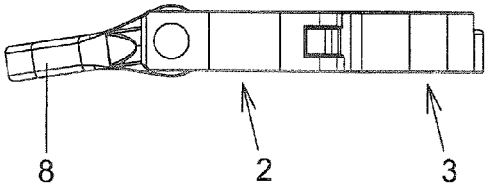
Figure 12:
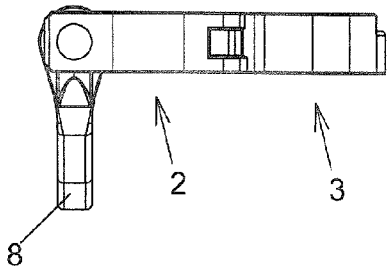

The arrangement of said indentations 12 in the case of the exemplary embodiment shown in this case can be seen particularly well in FIG. 7. The leg 8 comprises, as can be seen in FIG. 2, at least one elevation 13 which is able to latch into the corresponding indentation 12. Consequently, it is possible for the clevis type eyelet 6 to latch into individual or several preferred pivot positions. When adjusting from one pivot position into the other pivot position, a certain torsional resistance has to be overcome. The elevation 13 has to be pivoted out of the indentation 12 for this purpose, the elevation 13 slipping along the indentation. This subsequently leads to the leg 8 deforming elastically. The preloading required for this purpose in the directions 25 is provided in the exemplary embodiment shown in part by the leg 8 itself, but also in part by the sleeve 10 or the elastic ring 31 thereof. In other words, it is consequently possible to deform the sleeve 10 in its longitudinal extension and thereby to enable the transition from one pivot position to the other pivot position of the clevis type eyelet 6. When the clevis type eyelet 6 reaches the next pivot position, the elevation 13 of the clevis type eyelet 6 latches in the indentation 12 and the sleeve 10, or the ring 31 relaxes again in a corresponding manner. FIGS. 9 to 12 show the two pivot positions of the exemplary embodiment in which latching-in occurs. The clevis type eyelet 6 can naturally be pivoted in relation to the remaining buckle part 2 in any arbitrary position lying between the two latched-in pivot positions and also beyond both pivot positions and can be positioned on the basic body 11 without latching-in. As already mentioned, it is also possible to arrange the elevations 13 on the basic body 11 and the corresponding indentations 12 on the leg 8.

| Key to the Reference Numerals: | |
|---|---|
| 1 | Belt buckle |
| 2 | Buckle part |
| 3 | Other buckle part |
| 4 | Connecting part |
| 5 | Bar |
| 6 | Clevis type eyelet |
| 7 | Pivot axis |
| 8 | Leg |
| 9 | Hole |
| 10 | Sleeve |
| 11 | Basic body |
| 12 | Indentation |
| 13 | Elevation |
| 16 | Latching device |
| 17 | Latching element |
| 18 | Plug-in projection |
| 19 | Plug-in projection receiver |
| 20 | Spring |
| 21 | Bolt |
| 22 | Radius |
| 23 | Circle |
| 24 | Opening |
| 25 | Direction |
| 26 | Belt |
| 27 | Belt |
| 28 | Other bar |
| 29 | Hole |
| 30 | Portion |
| 31 | Elastic ring |

The invention claimed is:

1. A belt buckle for releasably connecting a first belt to a second belt, the belt buckle comprising:

a first buckle part fastenable to the first belt; and a second buckle part fastenable to the second belt, the first buckle part comprising:

a basic body including a connecting part for releasably connecting the first buckle part to the second buckle part, a bar configured to fasten the first belt to the first buckle part, and a clevis type eyelet for hooking a karabiner into the first buckle part, wherein the clevis type eyelet is fastened so as to be pivotable about a pivot axis, and the pivot axis is arranged coaxially with respect to a longitudinal axis of the bar, wherein the bar is part of the clevis type eyelet, wherein the bar is guided through a sleeve, the sleeve including a first side and a second side opposite from the first side, and wherein the first buckle part further includes an opening defined by the clevis type eyelet and the first side of the sleeve, and a gap defined between the basic body and the second side of the sleeve, the gap configured to receive the first belt therethrough.

2. The belt buckle as claimed in claim 1, wherein the bar and a leg form the clevis type eyelet.

3. The belt buckle as claimed in claim 2, wherein the bar is guided through holes in the leg.

4. The belt buckle as claimed in claim 3, wherein the sleeve is arranged between regions of the leg comprising the holes and supports the regions of the leg comprising the holes.

5. The belt buckle as claimed in claim 4, wherein the sleeve is a multi-part sleeve.

6. The belt buckle as claimed in claim 4, wherein the sleeve exerts forces on the regions of the leg comprising the holes in a direction away from one another.

7. The belt buckle as claimed in claim 1, wherein the clevis type eyelet comprises at least one pivot position and in said pivot position latches in the first buckle part.

8. The belt buckle of claim 7, wherein there are a plurality of pivot positions.

9. The belt buckle as claimed in claim 1, wherein a circle which inscribes said opening comprises a minimum radius of at least 5 mm.

10. The belt buckle of claim 9, wherein the opening is bordered by the clevis type eyelet in a circumferentially closed manner.

11. The belt buckle as claimed in claim 1, wherein upon being connected together, the first and second buckle parts latch onto one another by a latching device of the belt buckle and a latching element of the latching device is actuatable to release the first and second buckle parts from one another.

12. A belt buckle for releasably connecting a first belt to a second belt, the belt buckle comprising:

a first buckle part fastenable to the first belt; and a second buckle part fastenable to the second belt, the first buckle part comprising:

a basic body including a connecting part for releasably connecting the first buckle part to the second buckle part, a bar configured to fasten the first belt to the first buckle part, and a leg of a clevis type eyelet defining an opening on one side of the bar, the opening configured to receive a karabiner, wherein a gap is defined between the bar and the basic body on a side of the bar opposite from the opening, the gap being configured to receive the first belt therethrough, and wherein the leg is fastened so as to be pivotable about a pivot axis, and the pivot axis is arranged coaxially with respect to a longitudinal axis of the bar.

13. The belt buckle as claimed in claim 12, wherein the gap includes a height approximately equal to a height of the opening.

14. The belt buckle as claimed in claim 1, wherein the sleeve is an individual component separable from the clevis-type eyelet and the basic body.

15. The belt buckle as claimed in claim 11, wherein the latching device includes:

a projection having an undercut; and a projection receiver adjacent the latching element;

wherein the latching element is biased by a spring, and wherein the latching device is configured such that when the projection is inserted into the projection receiver, the projection moves the latching element against the force of the spring until the spring forces the latching element into the undercut.

16. The belt buckle as claimed in claim 15, wherein the latching device includes a pair of latching elements and the projection includes a pair of undercuts.

* * * * *